US012420164B2

(12) United States Patent
Luce

(10) Patent No.: US 12,420,164 B2
(45) Date of Patent: Sep. 23, 2025

(54) MULTI-USE GOLFING AID

(71) Applicant: Dameon Lyle Luce, Andover, MN (US)

(72) Inventor: Dameon Lyle Luce, Andover, MN (US)

( * ) Notice: Subject to any disclaimer, the term of this patent is extended or adjusted under 35 U.S.C. 154(b) by 833 days.

(21) Appl. No.: 17/713,684

(22) Filed: Apr. 5, 2022

(65) Prior Publication Data

US 2022/0409980 A1 Dec. 29, 2022

Related U.S. Application Data

(60) Provisional application No. 63/214,405, filed on Jun. 24, 2021.

(51) Int. Cl.
*A63B 71/06* (2006.01)
*A63B 69/36* (2006.01)

(52) U.S. Cl.
CPC ..... *A63B 71/06* (2013.01); *A63B 69/36* (2013.01); *A63B 2071/0694* (2013.01); *A63B 2225/09* (2013.01)

(58) Field of Classification Search
CPC . A63B 71/06; A63B 69/36; A63B 2071/0694; A63B 2225/09; A63B 2225/687; A63B 69/3632; A63B 69/3667; A63B 69/3621; A63B 2210/50
See application file for complete search history.

(56) References Cited

U.S. PATENT DOCUMENTS 4,583,739 A 4/1986 Kabbany
5,203,453 A 4/1993 Dirito
5,362,060 A 11/1994 Hinson
5,388,833 A 2/1995 Goyen, Jr.
5,417,428 A 5/1995 Warren
5,482,247 A * 1/1996 Smith ..... A63B 69/3685 473/282
5,730,659 A 3/1998 Morita
5,884,881 A 3/1999 Band et al.
6,029,599 A 2/2000 Hiltner, Jr.
6,283,875 B1 9/2001 Jones
6,346,051 B1 2/2002 Otsubo
6,428,422 B1 8/2002 Bennett
6,955,609 B1 * 10/2005 Hiltner, Jr. ..... A63B 57/20 248/166
D569,471 S 5/2008 Wiersma
8,246,482 B1 8/2012 Kim
9,017,181 B2 * 4/2015 Evans ..... A63B 57/40 248/170
D735,829 S 8/2015 Bagshot
D882,709 S 4/2020 Mickley
(Continued)

FOREIGN PATENT DOCUMENTS

GB 2485841 A 5/2012

*Primary Examiner* — Jeffrey S Vanderveen

(74) *Attorney, Agent, or Firm* — Westman, Champlin & Koehler, P.A.; Amanda M. Prose; Daniel J. Polglaze

(57) ABSTRACT

A golfing aid includes a connector portion, a first leg and a second leg. Each leg has a first end connected to the connector portion and at least one of the first and the second leg being pivotable about the connector portion. The connector portion includes predetermined positions for arranging the first leg and the second leg. The predetermined positions include a first pivot position, a second pivot position and a third pivot position.

17 Claims, 17 Drawing Sheets

(56) References Cited

U.S. PATENT DOCUMENTS

| | | | | |
|---|---|---|---|---|
| 2007/0149302 | A1 | 6/2007 | Mainiero et al. | |
| 2012/0056068 | A1 | 3/2012 | Maxwell | |
| 2014/0135142 | A1 | 5/2014 | David, Sr. | |
| 2021/0038956 | A1* | 2/2021 | Nappe | F16M 13/06 |

* cited by examiner

MULTI-USE GOLFING AID

CROSS-REFERENCE TO RELATED APPLICATION(S)

This application claims priority to U.S. provisional application No. 63/214,405, filed on Jun. 24, 2021, the content of which is hereby incorporated by reference in its entirety.

TECHNICAL FIELD

Various aspects of this disclosure relate generally to a multi-use golfing aid.

BACKGROUND

When golfing, multiple clubs may be used. When switching clubs, oftentimes the club is set down in the grass while using a different club. When preparing to leave the area, because the club is not in the line of sight, it is easy to forget the club in the grass until a user next needs it. This either results in a long trek to go find the club or a lost club that will need to be replaced. Further, those with physical injuries or conditions may have issues picking up a club from the ground.

Many golfers are interested in golfing training aids, however, because of the distances needed to travel, carrying extra equipment is often an issue.

The present description illustrates a golfing aid that combines an alignment aid with a golf club stand.

SUMMARY

In an embodiment, a golfing aid includes a connector portion, a first leg and a second leg. Each leg has a first end connected to the connector portion and at least one of the first and the second leg being pivotable about the connector portion. The connector portion includes predetermined positions for arranging the first leg and the second leg. The predetermined positions include a first pivot position, a second pivot position and a third pivot position.

In another embodiment, a method of using a golfing aid includes using the golfing aid in at least one use position, a straight ball alignment position, a club stand position, and a putting aid position. The method includes aligning two legs of the golfing aid in the straight position about a central hub for use of the golfing aid as a ball location marker; aligning the two legs of the golfing aid in the club stand position with the legs at an acute angle with respect to one another about the central hub, and angled away from the central hub, and gripping a golf club with a holding mechanism in the central hub; and aligning the two legs of the golfing aid separated by a user determined distance while the golfing aid is on its side for use in the putting aid position.

In another embodiment, a golfing aid includes a central hub having a gripping portion configured to grip a golf club with a friction fit, and a pair of legs coupled to and rotatable about the central hub and with respect to each other in a first direction with respect to the central hub; and rotatable in a second direction orthogonal to the first direction with respect to the central hub. A number of detents representing a plurality of operating positions for the two legs are arranged on the central hub and configured to align the pair of legs into three positions with respect to each other and to the central hub, a first position in which the legs engage a first set of the plurality of detents to align the pair of legs at an angle to each other of 180 degrees, a second position in which the legs engage a second set of the plurality of detents to align the pair of legs at an angle with respect to each other of less than 180 degrees and more than 0 degrees; and a third position in which the legs engage a third set of the plurality of detents to align the pair of legs at an angle with respect to each other of 0 degrees. The pair of legs is rotatable in the second direction when in the second position to form a club stand

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosure. In the following description, various embodiments of the disclosure are described with reference to the following drawings, in which.

DESCRIPTION

The following detailed description refers to the accompanying drawings that show, by way of illustration, specific details and embodiments in which the disclosure may be practiced.

Figure 1:
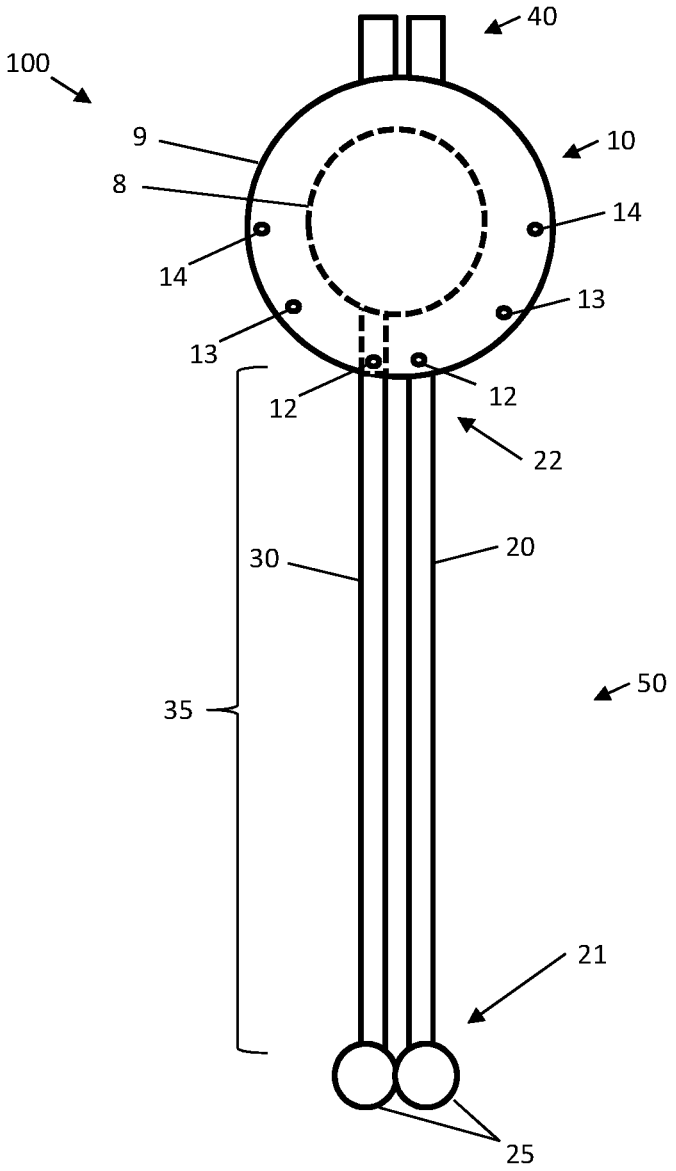
FIG. 1 shows a front view of an embodiment of a golfing aid.
Figure 2:
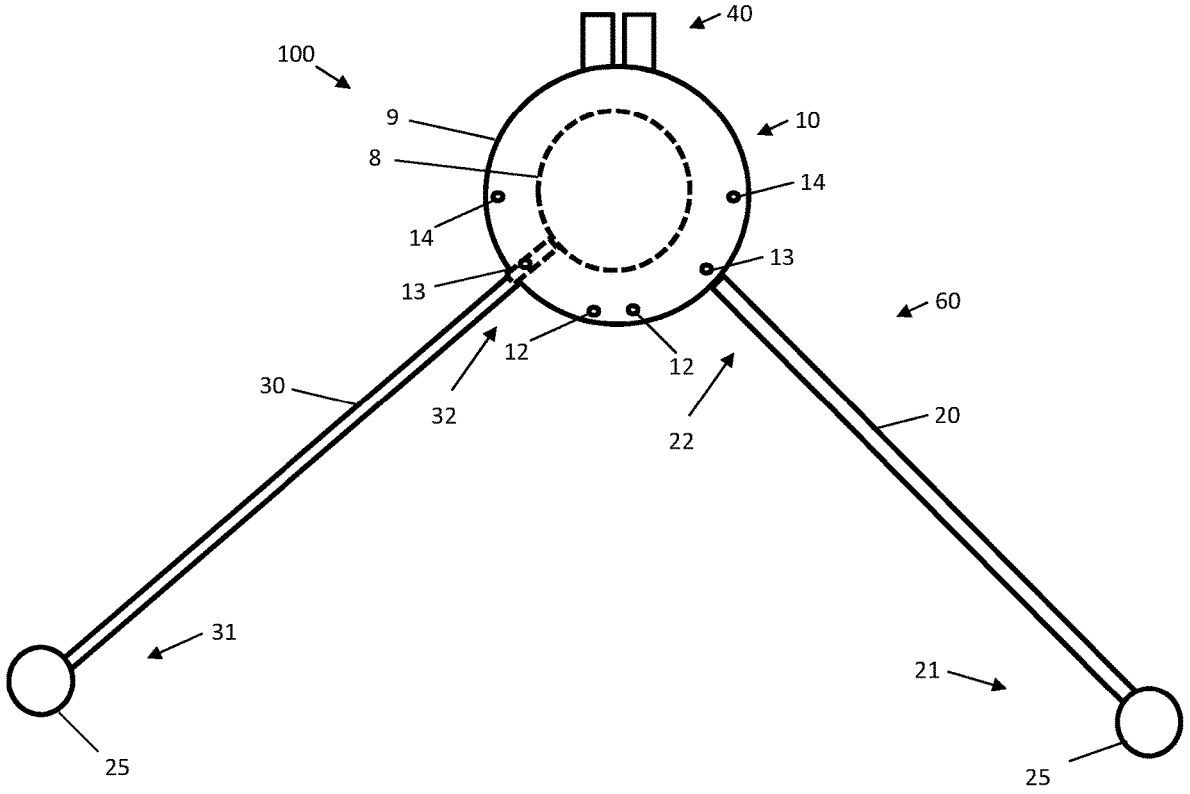
FIG. 2 shows a front view of an embodiment of a golfing aid.
Figure 3:
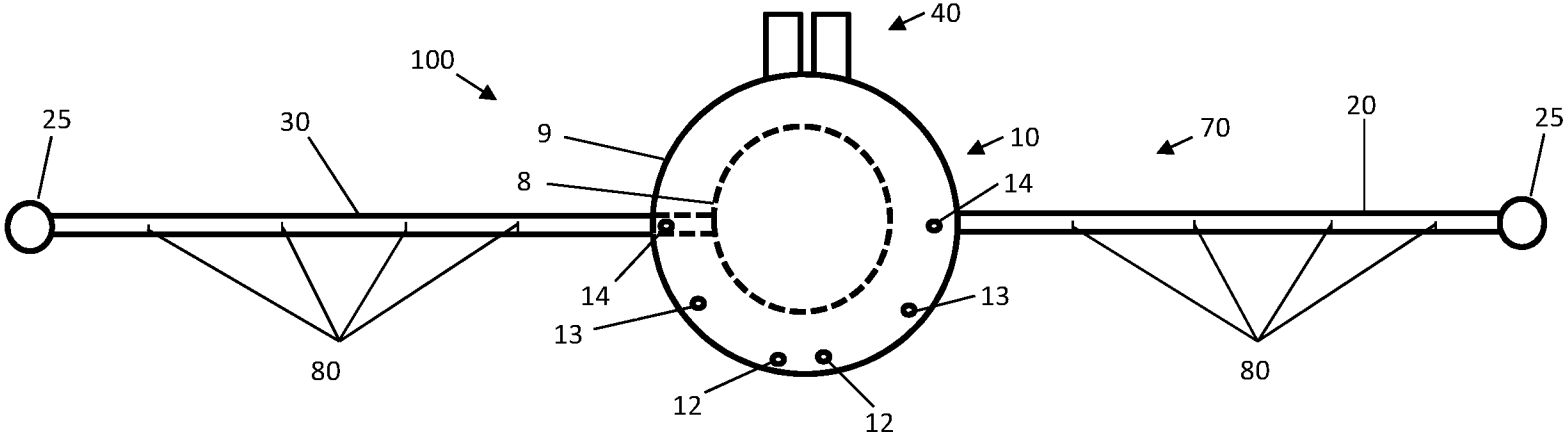
FIG. 3 shows a front view of an embodiment of a golfing aid.

The described disclosure provides a golfing aid 100 that provides a plurality of uses. As illustrated in FIGS. 1-3, golfing aid includes a connector portion 10 with a first leg 20 and a second leg 30 extending therefrom. Connector portion 10 is configured to have a rotatable portion to rotate at least one of first leg 20 and second leg 30 about connector portion 10. Connector portion further includes a holding mechanism 40 used to attach golfing aid 100 to a stick or a golf club. Golfing aid 100 has at least three different states, a first state 50, a second state 60 and a third state 70.

In an embodiment, connector portion 10 is a circular portion that includes an inner connector portion 8 and an outer connector portion 9. Inner connector portion 8 is arranged within outer connector portion 9, each moving independently of each other in opposite directions. Either a first end 22 of first leg 20 or first end 32 of second leg 30 is attached to inner connector portion 8; or the other leg, either a first end 22 of first leg 20 or a first end 32 of second leg 30, is connected to outer connector portion 9. Thus, first leg 20 and second leg 30 are each capable of moving in separate directions.

In an embodiment, a second end 21 of the first leg 20 and a second end 31 of the second leg 30 further include a stopper portion 25 coupled thereto to prevent second end 21 of the first leg 20 and second end 31 of the first leg 30 from penetrating the ground or support surface. Stopper portion 25 may be embodied as a thickened portion or a ball arranged on each of the legs 20, 30 that contact the ground.

In an embodiment, connector portion 10 further includes pivot positions to lock first leg 20 and second leg 30 in different positions. A first pivot position 12 (detent, hole, . . . ?) corresponds to first state 50, a second pivot position 13 corresponds to second state 60, and a third pivot position 14 corresponds to third state 70. One or both legs may be configured to move to the predetermined pivot positions. In one embodiment, only one leg is configured to be moved while the other is stationary. By way of non-limiting example, first leg 20 remains locked in place (where?) while second leg 30 is moved to second pivot position 13 or third pivot position 14 from first pivot position 12. In another embodiment, both first leg 20 and second leg 30 are configured to move. As a non-limiting example, both first leg 20 and second leg 30 are moved from first pivot position 12 to second pivot position 13 or third position 14.

First pivot position 12, second pivot position 13 and third pivot position 14 may be locked into place through a variety of means, to include, but not be limited to, a pin, a snap fit. Further, the positions 12, 13, and 14 are releasable using a single hand. The method may include, but is not limited to, using a button, a squeezing application or pressure release.

FIG. 1 provides a front view of golfing aid 100 in first state 50. FIG. 1 illustrates first leg 20 and second leg 30 locked in first pivot position 12 to be in first state 50. In first state 50 first leg 20 and second leg 30 are arranged essentially parallel to each other or at an angle of 0 degrees with respect to each other (the figures don't quite show this). When first leg 20 and second leg 30 are arranged together in first state 50, golfing aid 100 is compact and may be optionally placed in an easy to carry packaging.

FIG. 2 illustrates first leg 20 and second leg 30 locked in second pivot positon 13 to be in second state 60. Second pivot position 13 places the legs at an angle of greater than 0 degrees and less than 180 degrees with respect to each other.

Golfing aid 100 further includes holding mechanism 40 for securing a shaft of a golf club or a stick to connector portion 10. In an embodiment, holding mechanism 40 is arranged on the perimeter of connector portion 10. Thus, when holding mechanism 40 is attached to a golf club, the golfing aid 100 is positioned perpendicular to the golf club. However, holding mechanism 40, in certain embodiments, includes an angle changer to position golfing aid 100 at a position other than perpendicular. Although FIG. 2 illustrates holding mechanism 40 at the perimeter of connector portion 10, holding mechanism 40 may be arranged anywhere on connector portion 10.

Holding mechanism 40 has a variety of different configurations to include, but not be limited to, a pressure snap or a C-clamp. The holding mechanism 40 may be easily connected and disconnected from the golf club with one hand, in different ways such as, but not limited to, squeezing, pressing a release button or applying pressure to separate.

FIG. 3 illustrates golfing aid 100 in third state 70. First leg 20 and second leg 30 are locked in third pivot position 14. Third pivot position 14 places the legs at an angle of 180 degrees with respect to each other. Each leg 20, 30 further includes a plurality of marks 80 along length 35. Each mark 80 corresponds to different type of club.

In an embodiment leg 20 and leg 30 are of equal length 35. Length 35 may be in the range of 0.5-2 ft.

Figure 4:
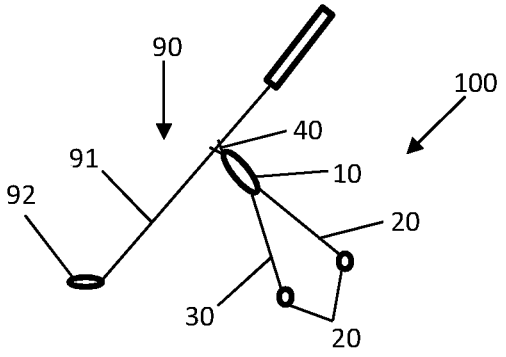
FIG. 4 shows an embodiment of the golfing aid with a golf club.

FIG. 4 illustrates golfing aid 100 in second state 60 arranged with golf club 90. As illustrated, golf club 90 is clamped to golfing aid 100 using holding mechanism 40. First leg 20 and second leg 30 are arranged at second pivot positon 13 of connector portion 10. Second end 21 of first leg 20, Second end 31 of second leg 30 and a club head 92 of golf club 90 are placed on the ground creating a tripod to stand golf club 90 such that a grip 93 of golf club 90 is positioned off the ground. Stopper portions 25 prevents first leg 20 and second leg 30 from penetrating the ground or support surface. This allows golf club 90 to be visible to a user, making it not only more visible, but also easier to access since a user does not need to bend over to retrieve golf club 90.

Figure 5:
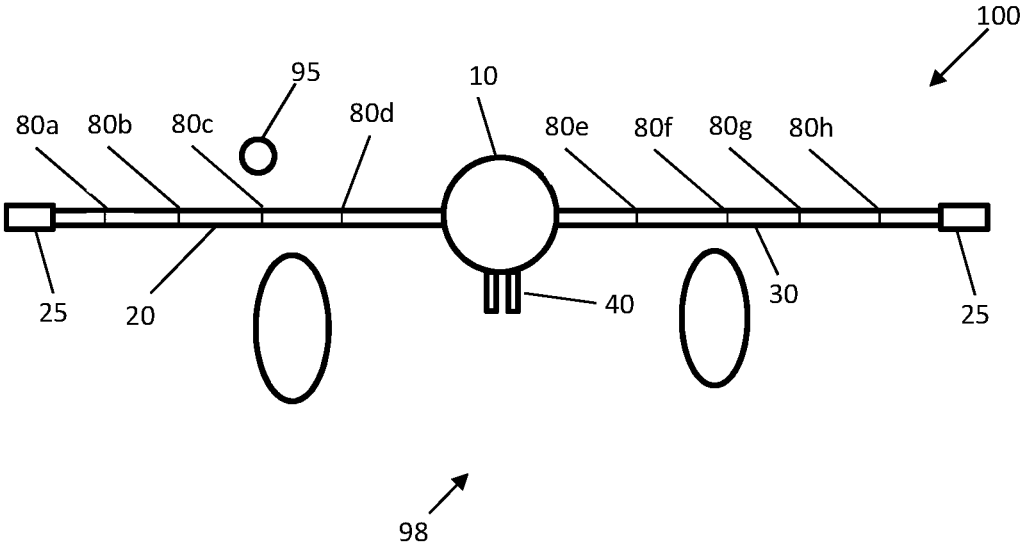
FIG. 5 shows an embodiment of the golfing aid as an alignment aid.
Figure 6A:
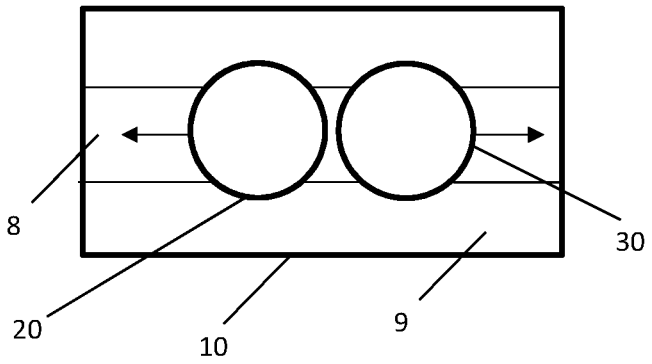
FIG. 6A shows an embodiment of a leg arrangement of the golfing aid.

FIG. 5 illustrates golfing aid 100 with first leg 20 and second leg 30 arranged at third pivot position 14 such that golfing aid 100 is in third state 70. In an embodiment, marks 80 correspond to a position to arrange ball 95 according to the club being used. By way of non-limiting example, marks 80 include driver marker 80*a*, 3-wood marker 80*b*, 5-wood marker 80*c*, 3-iron marker 80*d*, 7-iron marker 80*e*, 8-iron marker 80*f*, 9-iron marker 80*g*, pitching wedge marker 80*h* and sand wedge marker 80*i*. There may be fewer or greater number of marks 80 than that illustrated. Further, marks 80 may correspond to different clubs than that mentioned above. In a non-limiting example, a user 98 using a 5-wood club aligns ball 95 with 5-wood marker 80*c*. User 98 positions their feet such that they are centered about connector portion 10. Maybe more explanation here FIG. 6A illustrates an embodiment of first leg 20 and second leg 30. In the embodiment, each leg 20, 30 has an elongated, cylindrical shape such that a cross-section is circular. Further, each leg 20, 30 in certain embodiments may be arranged planar to each other such that the legs are arranged side-by-side. Either first leg 20 or second leg 30 is in connection with inner connector portion 8 and the other leg, either first leg 20 or second leg 30, is in connection with outer connector portion 9. In certain embodiments, first leg 20 and second leg 30 move, or rotate, in opposite directions, as shown by the arrows (number) in FIG. 6A.

Figure 6B:
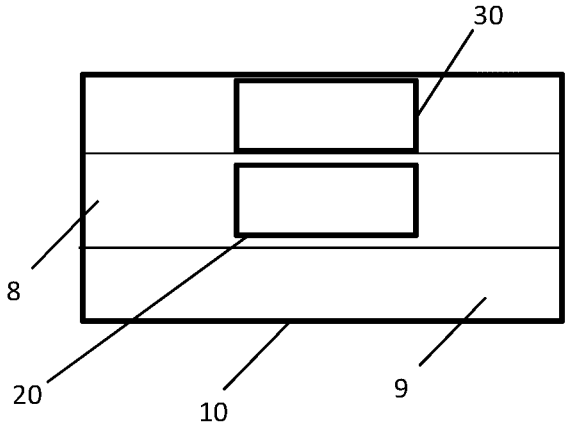
FIG. 6B shows an embodiment of a leg arrangement of the golfing aid.

FIG. 6B illustrates another embodiment of first leg 20 and second leg 30. In this particular embodiment, legs 20, 30 are flat, or have an elongated rectangular shape. Further, each leg 20, 30, in certain embodiments, may be arranged on parallel planes from each other, such that one is arranged on top of the other. In the illustrated embodiment, first leg 20 is connected to inner connector portion 8 and second leg 30 is connected to outer portion 9. Legs 20, 30 can move or rotate in either direction to create an angle with respect to each other.

Figure 7:
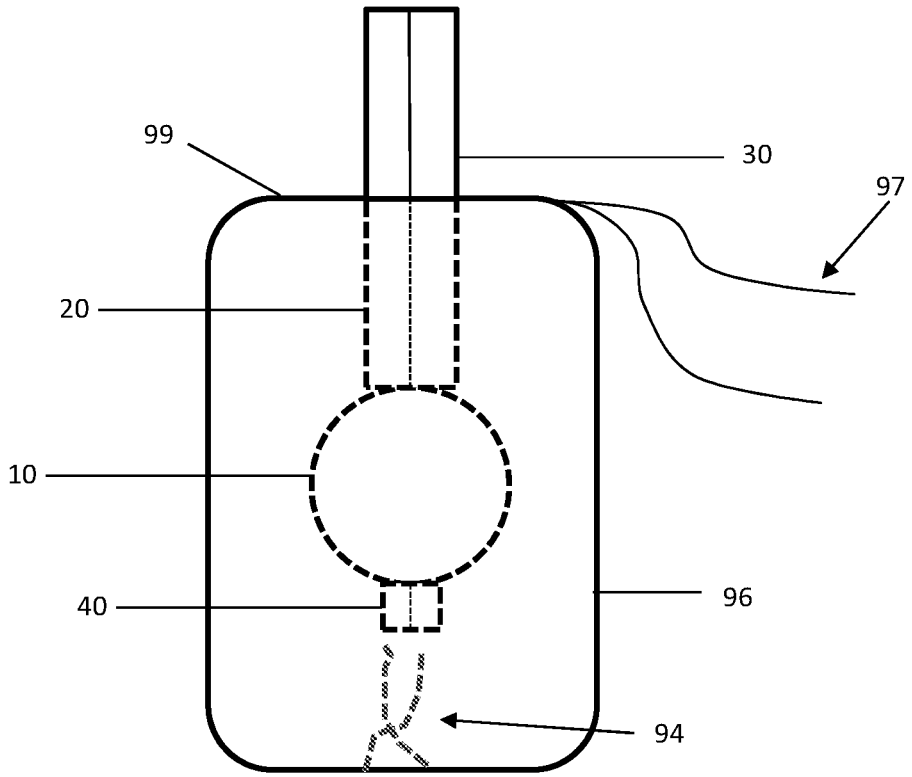
FIG. 7 shows an embodiment of a cover for the golfing aid.

FIG. 7 illustrates golfing aid 100 in first state 50 being placed in a cover 96. When legs 20, 30 are arranged at first pivot position 12 golfing aid 100 may be placed in cover 96 through an opening 99. Cover 96 is both a protective casing and provides a convenient way to transport golfing aid 100. Cover 96 may optionally include a cover closure 97. Cover closure 97 may be embodied as draw strings that close opening 99 of cover 97. In an embodiment cover 96 further includes an interior securing mechanism 94. Interior securing mechanism 94 secures golfing aid 100 to interior of cover 96. Interior securing mechanism 94 includes any means that can secure an object to cover 96, but in an embodiment may include strings.

Figure 8:
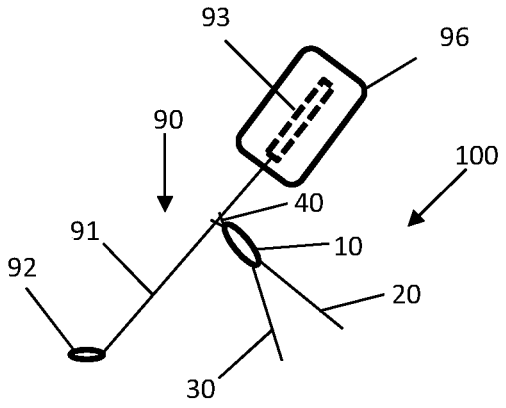
FIG. 8 shows an embodiment of the cover of FIG. 7 used on a golf club.

FIG. 8 illustrates another embodiment of the use of cover 96. When golfing aid is standing golf club 90 in an up-right position, cover 96 covers grip 93 to protect grip 93 from the outdoor elements, such as rain. Interior securing mechanism 94 may be further included to secure cover 96 to golf club 90.

Figure 9:
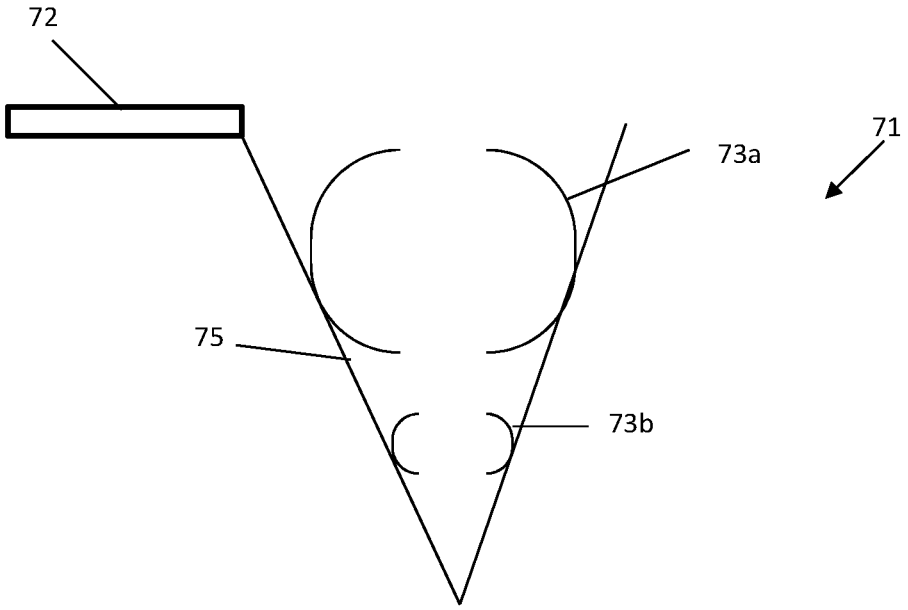
FIG. 9 shows an embodiment of an accessory attachment.
Figure 10:
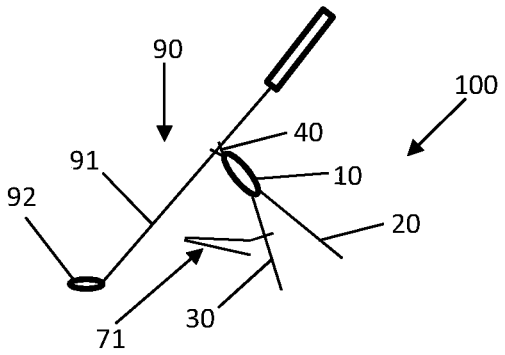
FIG. 10 shows an embodiment of the accessory attachment of FIG. 9 attached to the golfing aid

FIG. 9 illustrates an embodiment of an accessory attachment 71 to attach onto at least one of first leg 20 and second leg 30. Accessory attachment 71 is used to hold any number of accessories while user 98 is playing the game. Accessories may include gloves, smoking implements, i.e., cigarettes and/or cigars, and/or keys. Accessory attachment 71 includes a frame 75. Frame 75 may be of a triangular shape with an open side. Within frame 75 is at least one holder 73. In the embodiment illustrated in FIG. 9, frame 75 includes a first holder 73*a* and a second holder 73*b*. First holder 73*a* and second holder 73*b* may be different shapes and sizes to accommodate different sized and shaped accessories. Accessory attachment 71 further includes a holder clamp 72 to attach frame 75 to the at least one leg 20, 30. Holder clamp 72 may include any type of securing mechanism that can secure frame 75 to leg 20, 30 in a manner that is secure FIG. 10 illustrates an embodiment of accessory attachment 71 attached to leg 30. Accessory attachment 71 should be attached to leg 30 in a manner that is parallel to the ground to prevent the accessory from falling from accessory attachment 71.

Figure 11:
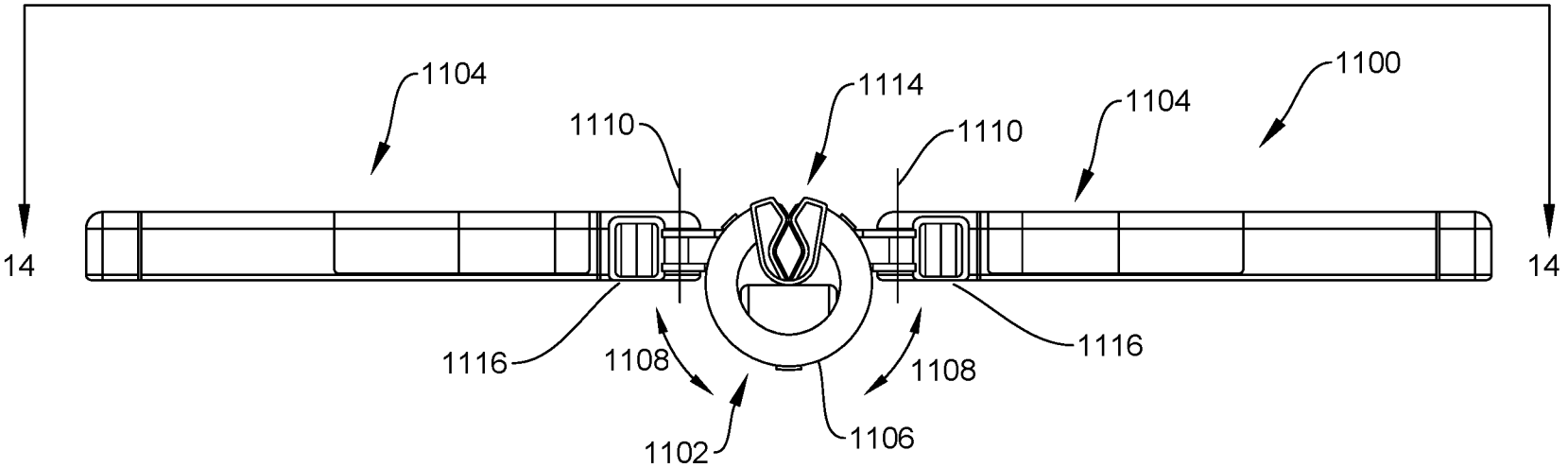
FIG. 11 is a top view of a golfing aid according to another embodiment.
Figure 12:
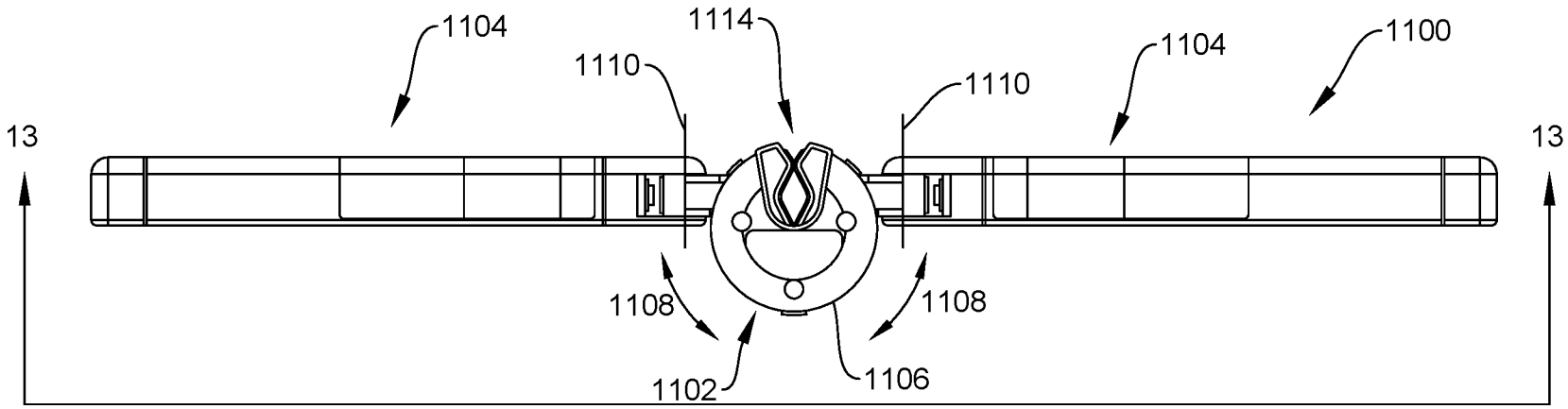
FIG. 12 is a bottom view of the golfing aid of FIG. 11.
Figure 15:
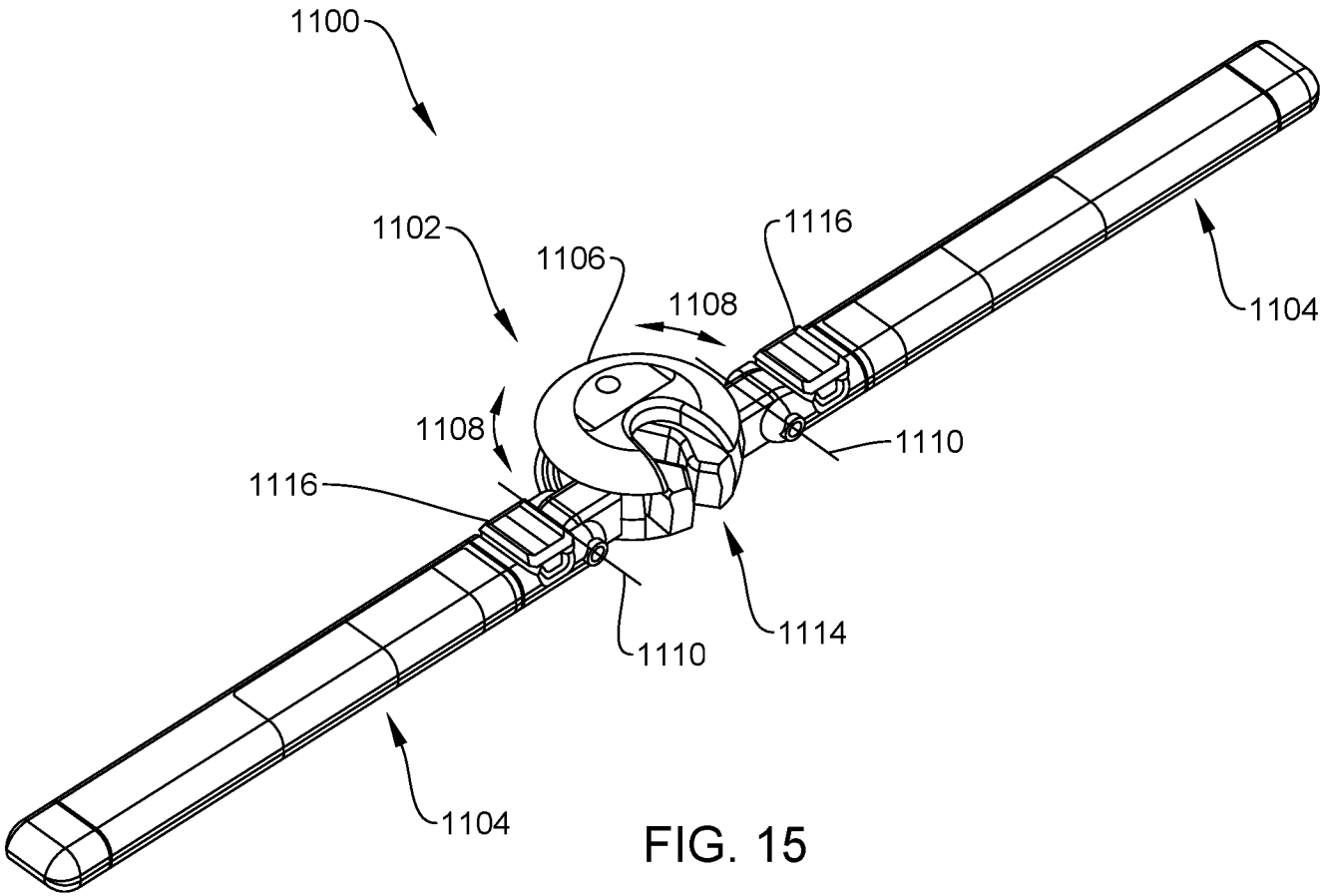
FIG. 15 is a perspective view of the golfing aid of FIG. 11.

FIGS. 11-15 illustrate an alternate embodiment of a golfing aid 1100, shown in a first, swing aid configuration in top view (FIG. 11), bottom view (FIG. 12), side view along lines 13-13 of FIG. 12 (FIG. 13), opposite side view along lines 14-14 of FIG. 11 (FIG. 14), and perspective view (FIG. 15). Golfing aid 110 operates similarly to golfing aid 100, in that it has a central hub 1102 and legs 1104 that extend therefrom. The legs 1104 are movable with respect to the central hub 1102, and may be rotated to an angle with respect to the central hub 1102, and from the central hub 1102 in a different direction.

Golfing aid 1100 comprises in this embodiment a connector portion, or central hub, 1102, to which two legs 1104 are rotatably connected. The legs 1104 are rotatable about a circumference 1106 of the center hub in the directions of arrows 1108. Further, each leg is rotatable about an axis 1110 in the direction of arrow 1112. Using a combination of rotation in the direction of arrows 1108 and arrows 1112, the golfing aid 1100 may be configured for a number of different uses.

Central hub 1102 has a gripping member 1114 that is contained with the central hub 1102 and is configured to grip a shaft of a golf club with a friction fit. The side jaws of the gripping member are displaceable with some degree of force, and are spring tensioned to retain a golf club shaft therein when one is inserted into the gripping member 1114.

Figure 13:
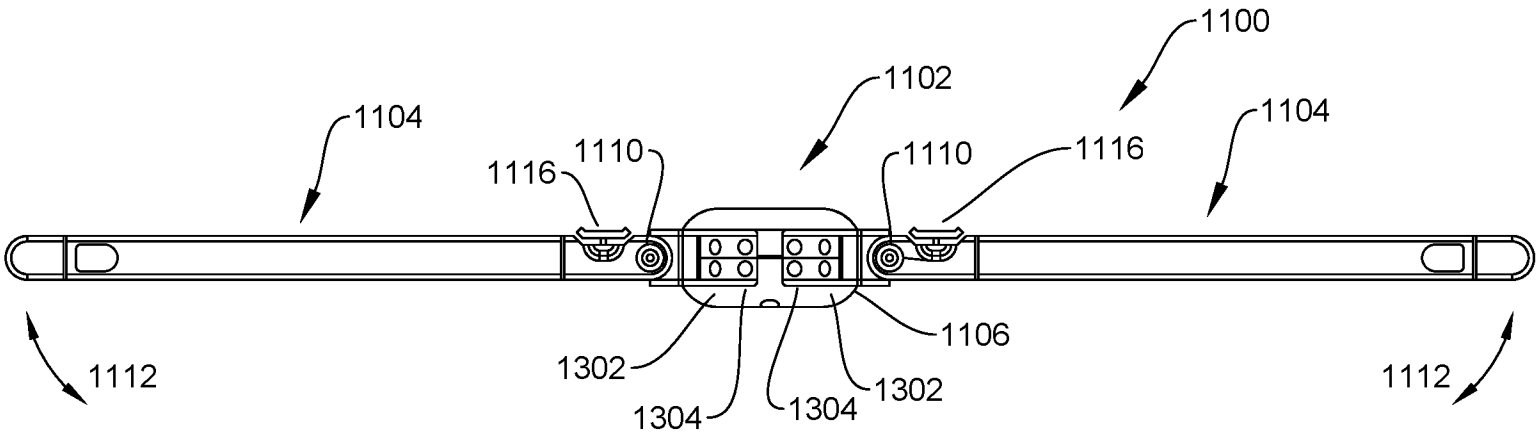
FIG. 13 is a view taken along lines 13-13 of FIG. 12.
Figure 14:
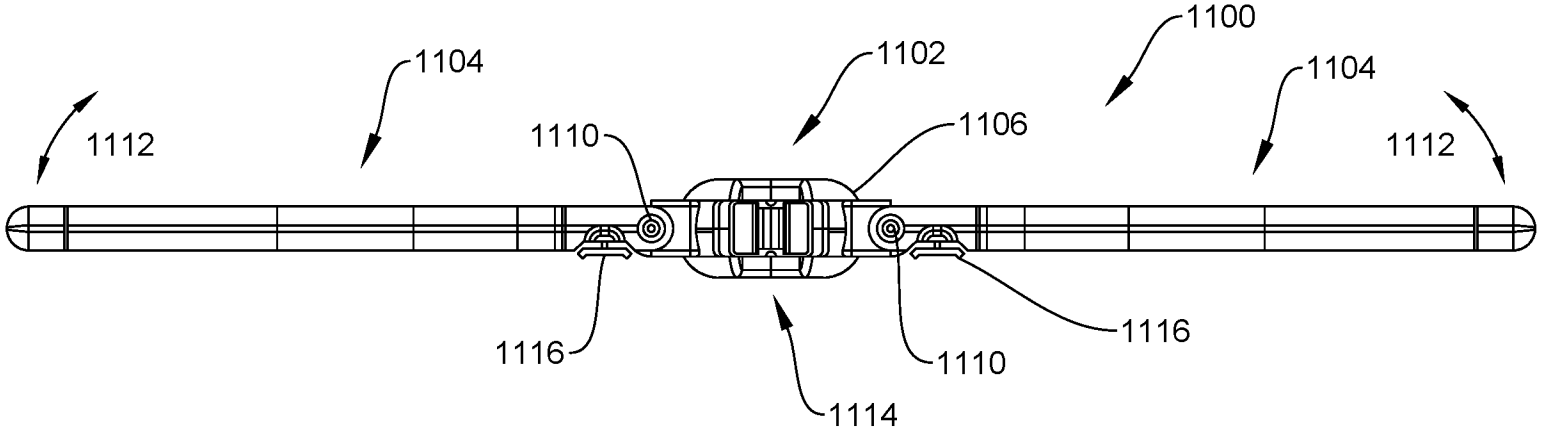
FIG. 14 is a view taken along lines 14-14 of FIG. 11.
Figure 20:
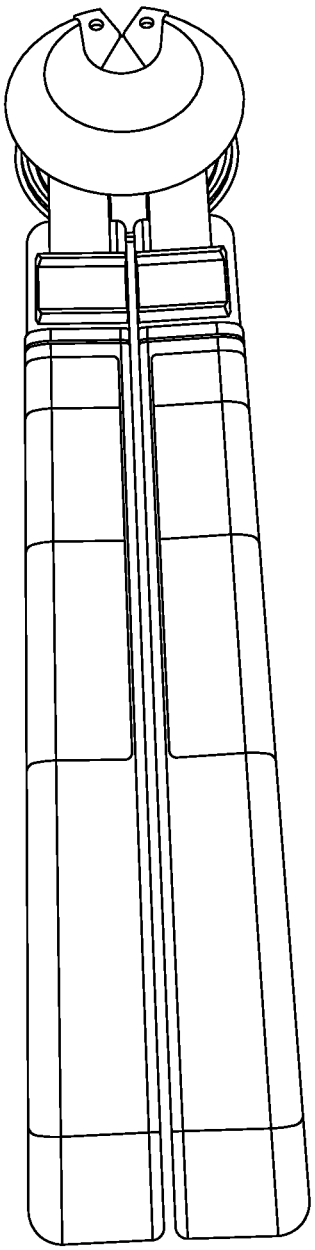
FIG. 20 is a view of the golfing aid of FIG. 11 in a folded storage position.

Referring to FIG. 13, detent positions 1302, 1304 are shown in central hub 1102. Detent positions (not shown) that are similar to 1302 and 1304 are used when legs 1104 are in the straight position 180 degrees apart as shown in FIGS. 11-15. When it is desired to change the configuration of the legs 1104 about the central hub 1102, the legs are rotated about the central hub as shown in arrows 1108 to engage detents 1302 to place the legs 1104 at an angle for use of the golfing aid 1100 as a stand for a golf club (see FIG. 16). Once legs 1104 are in the detents 1302, they may be rotated in the direction of arrows 1112 to form the stand as shown in FIG. 20. Locking buttons 1116 allow for the legs 1104 to be rotated about axes 1110 when depressed. The locking buttons 1116 release the legs 1104 from the straight configuration to allow the rotation about the axes 1110. The legs 1104 lock into place at an angle $\alpha$ to the central hub 1102 as shown in FIG. 20. To return the legs 1104 to the straight position as shown in FIGS. 11-15, the buttons 1116 are again released, and the legs 1104 may be rotated back to the straight position.

Figure 17:
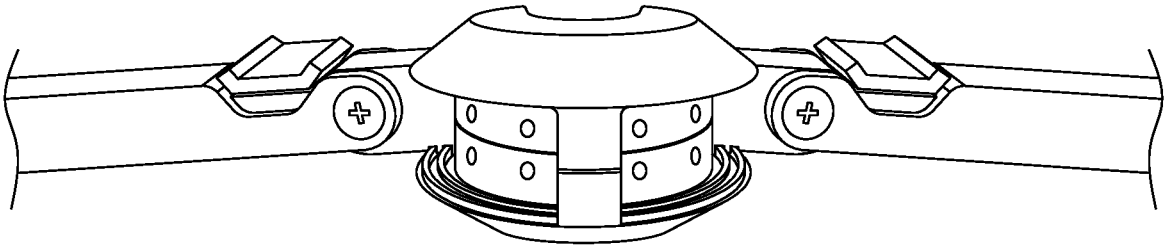
FIG. 17 is a close-up view of a portion of FIG. 14.

FIG. 17 is a close-up view of the central hub 1102, portions of the legs 1104, axes 1110, buttons 1116, and detents 1302 and 1304.

Figure 18:
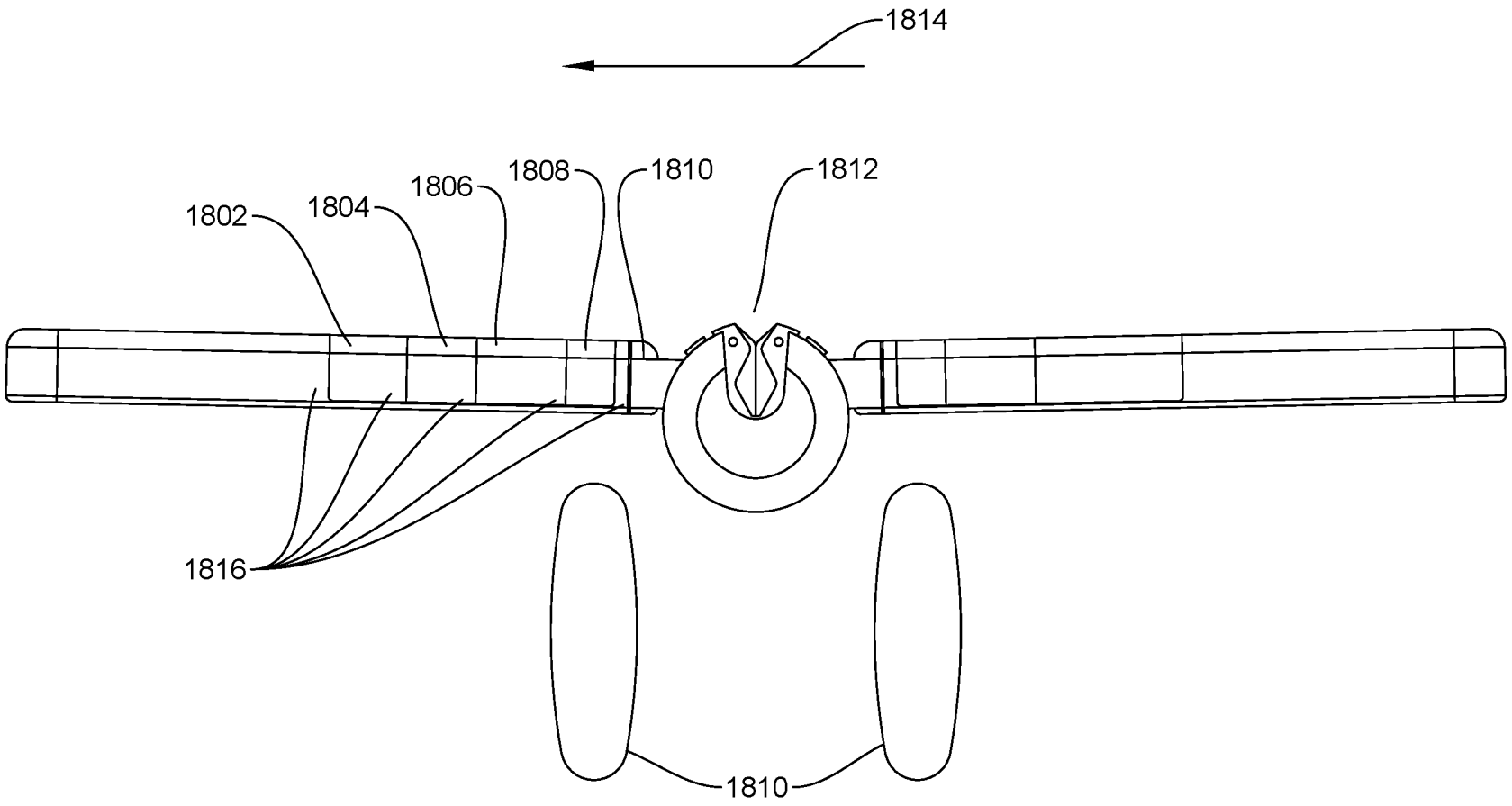
FIG. 18 is a view of the golfing aid of FIG. 11 in use as a swing aid.

FIG. 18 illustrates another use of the golfing aid 1100. In FIG. 18, the golfing aid 1100 is arranged in the straight position as shown in FIGS. 11-15. Markings on the golfing aid 1100 are shown for stance alignment with respect to a ball, and for a specific club or clubs. In this embodiment, a golfer takes a stance as generally shown at 1800, with placement of the golfer's feet on either side of the golfing aid 1100 central hub 1102. It should be understood that the stance is not shown perfectly aligned, but the stance is in one embodiment aligned to a center of the central hub. A golf ball is placed at one of the locations 1802, 1804, 1806, 1808, 1810, or 1812, depending on the club chosen for the ensuing shot.

Location 1802 (D) is a suitable ball placement for a shot with a driver. Location 1804 (FW) is a suitable ball placement for a shot with a fairway wood. Location 1806 (H) is a suitable ball placement for a shot with a hybrid club. Location 1808 (LI) is a suitable ball placement for a shot with a long iron (e.g., a 2-iron to a 5-iron). Location 1810 (MI) is a suitable ball placement for a shot with a middle iron (e.g., a 6-iron to a 9-iron). Location 1812 (W) is a suitable ball placement for a shot with a wedge. Balls are hit in this embodiment in the direction of arrow 1814 for a right-handed golfer. Should a golfer be left-handed, the stance would be taken on the other side of the golfing aid 1100, that is, on the gripping member side of the golfing aid. The placement locations relative to a center of the golfer's stance places the ball in a proper position for a correctly executed shot. That is, the longer the club being used is, the father forward in the stance the ball is.

A golfer using the golfing aid 1100 in the straight configuration may also use the golfing aid 1100 to square a club face for a shot by lining the club face up straight with one of the lines 1816 perpendicular to the front face of the golfing aid. Such lines are provided and shown in FIG. 18. The user uses the lines by lining up a leading edge of a club with a line 1816 provided next to or with the club label. When the club face is aligned with the line 1816, the club face is square and in proper position for a proper swing and shot.

Figure 19:
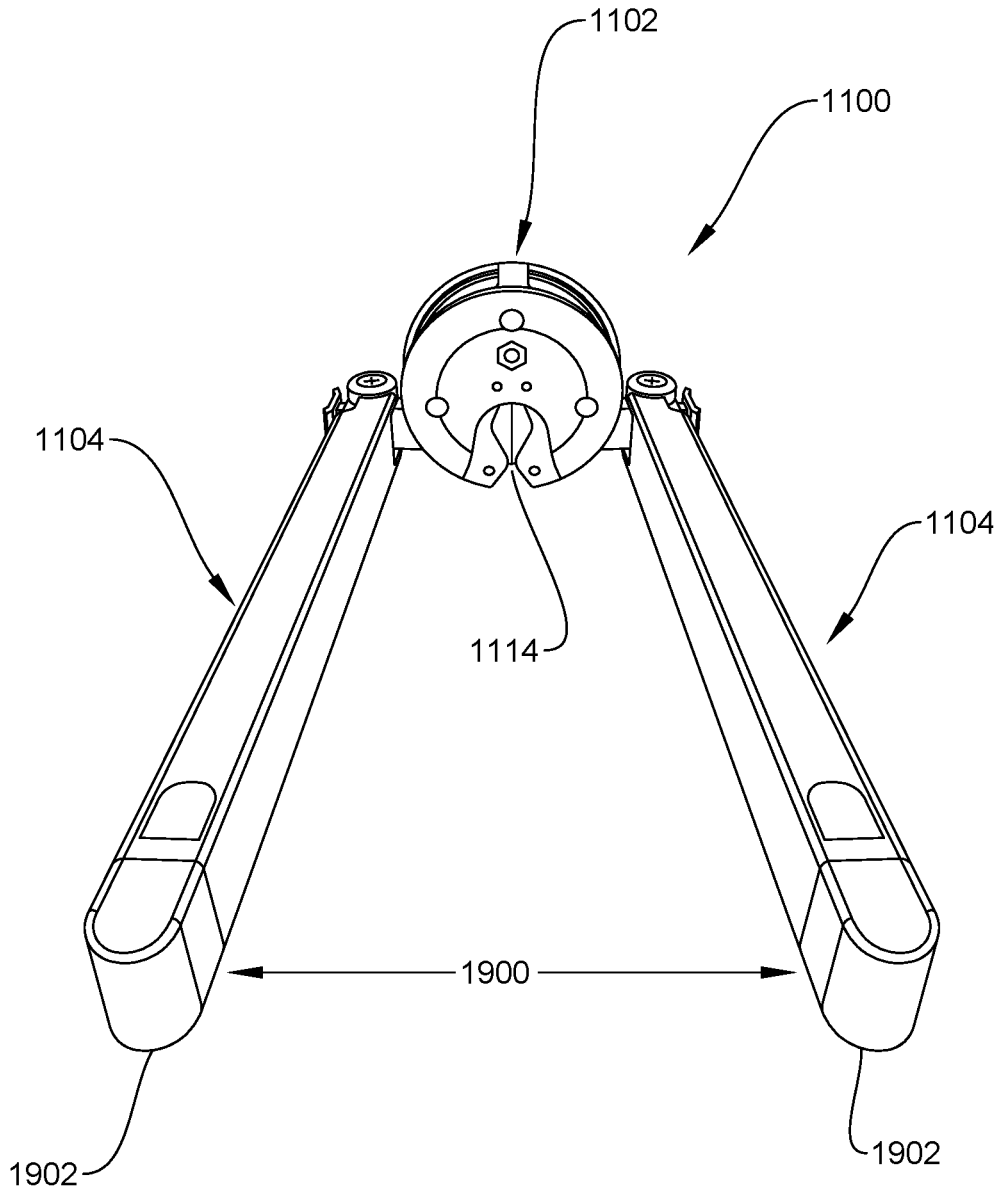
FIG. 19 is a view of the golfing aid of FIG. 11 in use as a putting aid.

Another use of the golfing aid is shown in FIG. 19. In FIG. 19, the legs 1104 are folded in the direction of arrows 1108 but not rotated away from the straight position of FIGS. 11-15. In this configuration, the golfing aid may be used as a putting aid, with the legs 1104 separated by an adjustable distance 1900 at their distal ends 1902. In this configuration, a golfer may strike a putt toward the central hub 1102 using the legs 1104 as a target. The distance may be larger or smaller depending on the angle of the legs 1104.

The golfing aid 1100 is shown in a storage position in FIG. 20. In this configuration, the legs 1104 are rotated in the direction of arrows 1108 to the detent positions 1304, but not rotated about arrows 1112. The golfing aid is in a compact position in this configuration. A bag is provided in one embodiment that is sized to store the golfing aid 1100 therein when it is in the configuration of FIG. 20.

Figure 16:
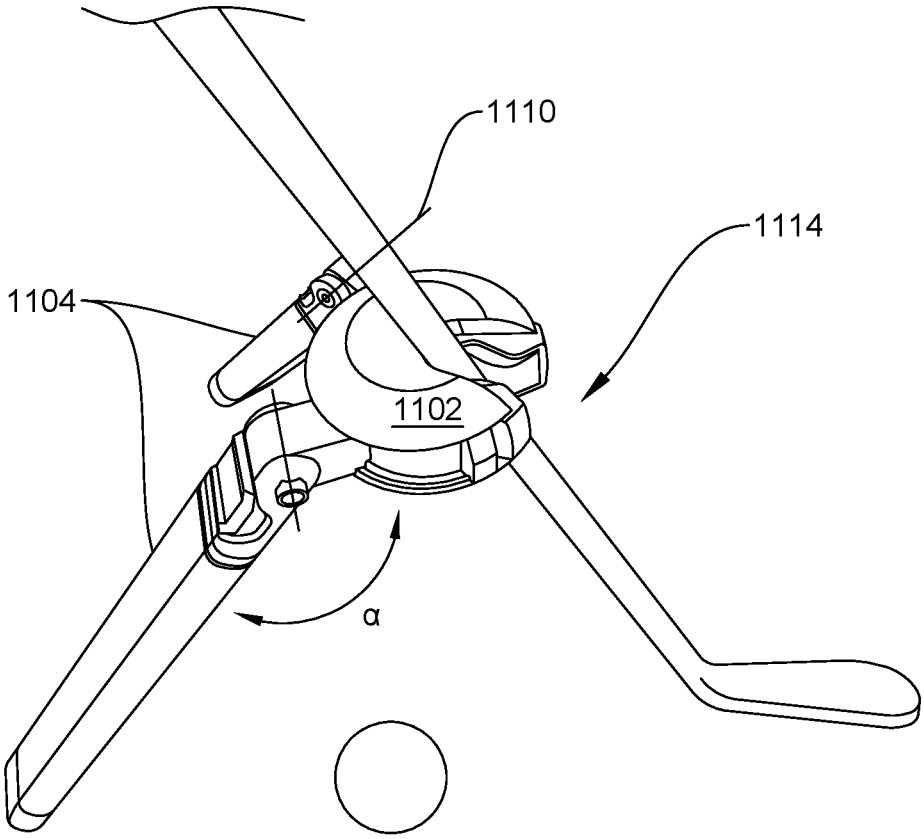
FIG. 16 is a view of the golfing aid of FIG. 11 in use as a club stand.
Figure 21:
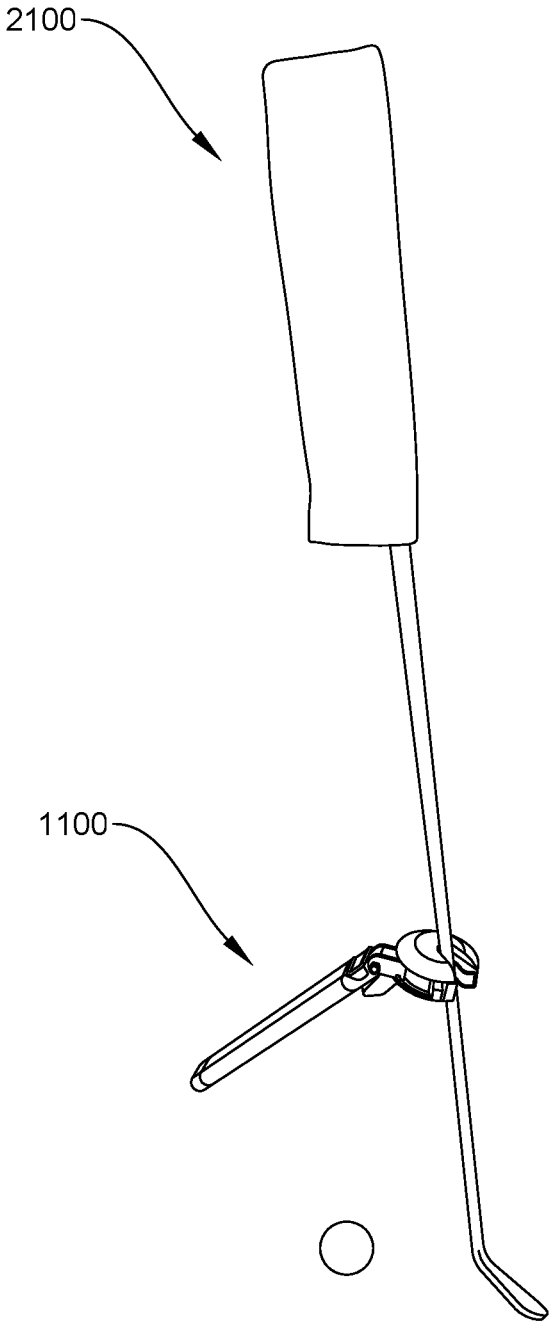
FIG. 21 is a view of the golfing aid of FIG. 11 in use as a club stand, with a cover in use as a grip protector.

A bag 2100 is shown in use for another configuration in FIG. 21. Bag 2100, which is sized to hold and store golfing aid 1100 when it is in the position of FIG. 20, may also be used when the golfing aid 1100 is in use as a club stand (FIGS. 16, 21). Bag 2100 in this configuration, is used as a cover for the grip of a club. This may be done to keep sun off the grip, or to keep the grip dry during rain or the like.

The golfing aid in use as a club stand assists in retention of golf clubs, especially on or around the greens of a golf course, where players often take more than one club, and often leave e non-putting club next to the green for putting. Then, when the hole is completed, it is a not uncommon situation where a golfer leaves the greenside club behind, and has to go back looking for it. When the club is in the club stand golfing aid 1100, such an action is less likely, since the club will be more visible by the side of the green.

While the disclosure has been particularly shown and described with reference to specific embodiments, it should be understood by those skilled in the art that various changes in form and detail may be made therein without departing from the scope of the disclosure as defined by the appended claims. The scope of the disclosure is thus indicated by the appended claims and all changes which come within the meaning and range of equivalency of the claims are therefore intended to be embraced.

What is claimed is:

1. A golfing aid, comprising:

a connector portion;

a first leg and a second leg, each having a first end connected to the connector portion, at least one of the first and the second leg being pivotable about the connector portion;

a holding mechanism, the holding mechanism mounted on the connector portion to provide a holder for a golf club, the holder configured to releasably secure the golf club to the golfing aid to form a stand for the golf club, wherein the connector portion comprises predetermined positions for arranging the first leg and the second leg, the predetermined positions comprising a first pivot position, a second pivot position and a third pivot position; and wherein the holding mechanism is integral with the connector portion, and comprises a spring tension holding mechanism.

2. The golfing aid of claim 1, wherein the first pivot position arranges the first leg and the second leg in a closed state, where the first leg is positioned at an angle, with respect to the second leg, of 0 degrees.

3. The golfing aid of claim 1, wherein the second pivot position arranges the first and the second leg in a stand state, where the first leg is positioned at an angle, with respect to the second leg, of greater than 0 degrees but less than 180 degrees.

4. The golfing aid of claim 1, wherein the third pivot position arranges the first leg and the second leg in an open state, where the first leg is positioned at an angle, with respect to the second leg, of 180 degrees.

5. The golfing aid of claim 1, and further comprising a plurality of marks on at least one of the first leg or the second leg, the plurality of marks representing ball placement adjacent to the golfing aid for use with a particular club identified by a chosen one of the plurality of marks.

6. The golfing aid of claim 5, wherein the plurality of marks comprise location marks for ball placement for a plurality of clubs including a driver, fairway wood, hybrid club, long iron, middle iron, and wedge.

7. The golfing aid of claim 5, wherein the plurality of marks include lines perpendicular to a straight position of the golfing aid for squaring a club face of a golf club used with the golfing aid.

8. The golfing aid of claim 1, wherein the first leg and the second leg have a cylindrical cross section.

9. The golfing aid of claim 1, wherein the first leg and second leg have a rectangular cross section.

10. The golfing aid of claim 1, wherein the one of the first leg and the second leg is fixed with respect to the connector portion, and the other of the first leg and the second leg is pivotable with respect to the one of the first leg and the second leg.

11. A method of using a golfing aid, comprising using the golfing aid in at least one use position, a straight ball alignment position, a club stand position, and a putting aid position, the method comprising:

providing a golfing aid configured for use in each of the straight ball alignment position, club stand position, and putting aid position, the golfing aid comprising a plurality of detents representing the use positions for two legs of the golf aid, the plurality of detents arranged on a central hub and configured to align the two legs into the use positions with respect to each other and to the central hub;

aligning the two legs of the golfing aid in the straight position about a central hub for use of the golfing aid as a ball location marker;

aligning the two legs of the golfing aid in the club stand position with the legs at an acute angle with respect to one another about the central hub, and angled away from the central hub, and gripping a golf club with a holding mechanism in the central hub;

aligning the two legs of the golfing aid separated by a user determined distance while the golfing aid is on its side for use in the putting aid position.

12. The method of claim 11, wherein using the golfing aid in the straight ball alignment position comprises:

addressing the putting aid in a stance about a connector portion thereof;

selecting a club to use for a golf shot; and placing a ball adjacent a mark, of a plurality of marks identifying a plurality of golf clubs, matching the elected club.

13. The method of claim 11, wherein using the golfing aid in the club stand position comprises:

rotating the two legs about the central hub to engage detents to place the two legs at an angle from each other, the angle less than 180 degrees; and rotating the two legs in a direction orthogonal to the first rotation to separate locking stand positions.

14. A golfing aid, comprising:

a central hub having a gripping portion configured to grip a golf club with a friction fit;

a pair of legs coupled to and rotatable about the central hub and with respect to each other in a first direction with respect to the central hub; and rotatable in a second direction orthogonal to the first direction with respect to the central hub;

a plurality of detents representing a plurality of operating positions for the two legs, the plurality of detents arranged on the central hub and configured to align the pair of legs into three positions with respect to each other and to the central hub, a first position in which the legs engage a first set of the plurality of detents to align the pair of legs at an angle to each other of 180 degrees, a second position in which the legs engage a second set of the plurality of detents to align the pair of legs at an angle with respect to each other of less than 180 degrees and more than 0 degrees; and a third position in which the legs engage a third set of the plurality of detents to align the pair of legs at an angle with respect to each other of 0 degrees;

wherein the pair of legs is rotatable in the second direction when in the second position to form a club stand.

15. The golfing aid of claim 14, and further comprising:

a plurality of marks on a leg of the two legs, the plurality of marks comprising ball placement positions for addressing a golf ball placed in alignment with a mark for a particular golf club identified by the mark; and a central hub mark on the central hub for addressing a golf ball placed in alignment with the central hub mark for a wedge club.

16. The golfing aid of claim 15, and further comprising a plurality of lines, a line adjacent each of the plurality of marks, the plurality of lines perpendicular to a face of the legs when the legs are in the first position, the lines configured as alignment lines for a club face of a club used with the golfing aid.

17. The golfing aid of claim 14, and further comprising:

a cover, the cover configured for storage of the golfing aid when the golfing aid is in the third position, and for covering and protecting a grip of a golf club supported by the golfing aid when the golfing aid is in the second position.

* * * * *